US010007202B2

(12) United States Patent
Ojima

(10) Patent No.: US 10,007,202 B2
(45) Date of Patent: Jun. 26, 2018

(54) POSITIVELY CHARGEABLE TONER

(71) Applicant: KYOCERA Document Solutions Inc., Osaka (JP)

(72) Inventor: Seishi Ojima, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days. days.

(21) Appl. No.: 15/550,908

(22) PCT Filed: Jul. 1, 2016

(86) PCT No.: PCT/JP2016/069676
§ 371 (c)(1),
(2) Date: Aug. 14, 2017

(87) PCT Pub. No.: WO2017/006870
PCT Pub. Date: Jan. 12, 2017

(65) Prior Publication Data

US 2018/0031993 A1 Feb. 1, 2018

(30) Foreign Application Priority Data

Jul. 7, 2015 (JP) ..... 2015-136180

(51) Int. Cl.
*G03G 9/08* (2006.01)
*G03G 9/093* (2006.01)
*G03G 9/087* (2006.01)

(52) U.S. Cl.
CPC ..... *G03G 9/09321* (2013.01); *G03G 9/08711* (2013.01); *G03G 9/08755* (2013.01); *G03G 9/09357* (2013.01); *G03G 9/09371* (2013.01)

(58) Field of Classification Search
CPC ..... G03G 9/09321; G03G 9/09357; G03G 9/09371; G03G 9/08711; G03G 9/08755
USPC ..... 430/110.2
See application file for complete search history.

(56) References Cited

FOREIGN PATENT DOCUMENTS

JP 2009-014757 A 1/2009

*Primary Examiner* — Mark A Chapman
(74) *Attorney, Agent, or Firm* — Studebaker & Brackett PC

(57) ABSTRACT

A positively chargeable toner includes a plurality of toner particles each including a core and a shell layer disposed over a surface of the core. The core contains a polyester resin. The shell layer covers at least 40% and no greater than 80% of an area of the surface of the core, $\zeta(4)$ is greater than 0 V. $\zeta(6)$ is less than 0 V. A relationship represented by $|\zeta(3)-\zeta(4)|>|\zeta(6)-\zeta(7)|$ is satisfied. $\zeta(3)$, $\zeta(4)$, $\zeta(6)$, and $\zeta(7)$ represent zeta potentials of the positively chargeable toner with the toner particles having no external additive. $\zeta(3)$, $\zeta(4)$, $\zeta(6)$, and $\zeta(7)$ are respectively measured in an aqueous medium at pH 3, pH 4, pH 6, and pH 7.

11 Claims, 1 Drawing Sheet

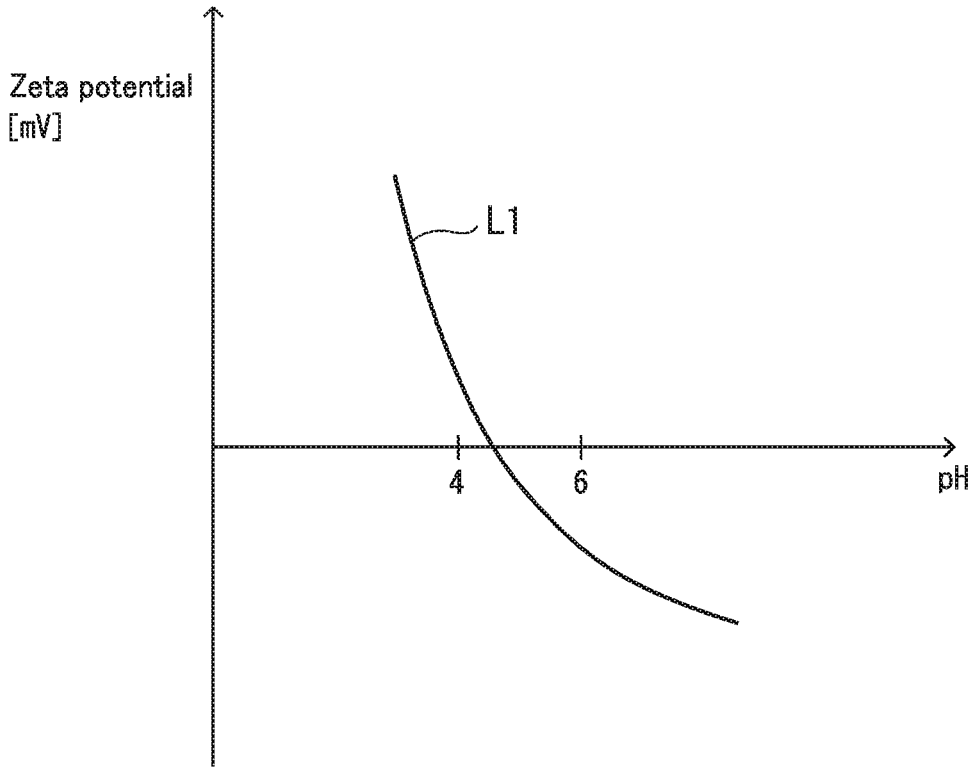
Zeta potential
[mV]
L1
4
6
pH

POSITIVELY CHARGEABLE TONER

TECHNICAL FIELD

The present invention relates to a positively chargeable toner, and particularly relates to a positively chargeable capsule toner.

BACKGROUND ART

Toner particles included in a capsule toner each include a core and a shell layer (capsule layer) disposed over a surface of the core. Toner particles described in Patent Literature 1 each has a shell layer (coat layers including fine resin particles containing a non-crystalline polyester resin.

CITATION LIST

Patent Literature

[Patent Literature 1]

Japanese Patent Application Laid-Open Publication No. 2009-14757

SUMMARY OF INVENTION

Technical Problem

However, only with the technique disclosed in Patent Literature 1, it is difficult to provide a toner that is excellent in high-temperature preservability and fixability and that is capable of preferable image formation.

The present invention was achieved in consideration of the above problem and an object thereof is to provide a toner that is excellent in both high-temperature preservability and fixability and that is capable of preferable image formation.

Solution to Problem

A positively chargeable toner according to the present invention includes a plurality of toner particles each including a core and a shell layer disposed over a surface of the core. The core contains a polyester resin. The shell layer covers at least 40% and no greater than 80% of an area of the surface of the core. $\zeta(4)$ is greater than 0 V. $\zeta(6)$ is less than 0 V. A relationship represented by $|\zeta(3)-\zeta(4)|>|\zeta(6)-\zeta(7)|$ is satisfied. $\zeta(3)$, $\zeta(4)$, $\zeta(6)$, and $\zeta(7)$ represent zeta potentials of the positively chargeable toner with the toner particles having no external additive. $\zeta(3)$, $\zeta(4)$, $\zeta(6)$, and $\zeta(7)$ are respectively measured in an aqueous medium at pH 3, pH 4, pH 6, and pH 7.

Advantageous Effects of Invention

The present invention can provide a toner that is excellent in both high-temperature preservability and fixability and that is capable of preferable image formation.

BRIEF DESCRIPTION OF DRAWINGS

FIGURE illustrates an example of a profile of zeta potential of toner mother particles in a positively chargeable toner according to an embodiment of the present invention.

DESCRIPTION OF EMBODIMENTS

An embodiment of the present invention will be described in detail. Note that unless otherwise stated, results (for example, values indicating shapes or properties) of evaluations that are performed on a powder (specific examples include toner cores, toner mother particles, an external additive, or a toner) are number averages of measurements made with respect to an appropriate number of particles. A particle diameter of a powder is a diameter of a representative circle of a particle (Heywood diameter: a diameter of a circle having the same area as a projection of the particle), unless otherwise stated.

Strength of a chargeable character is equivalent to ease of triboelectric charging, unless otherwise stated. A toner can for example be triboelectrically charged by mixing and stirring the toner with a standard carrier (anionic standard carrier: N-01, cationic standard carrier: P-01) provided by The Imaging Society of Japan. Surface potential of a toner particle is measured before and after the triboelectric charging using for example a kelvin probe force microscope (KFM). A portion having a larger change in charge potential before and after the triboelectric charging has a stronger chargeable character.

Strength of a hydrophobic character (or strength of a hydrophilic character) can for example be expressed as a contact angle for water drops (wettability for water). The greater the contact angle for water drops is, the stronger the hydrophobic character is.

An aqueous medium is a medium in which water is a main component (specific examples include pure water and a liquid mixture of water and a polar medium). The aqueous medium may function as a solvent. Solute may be dissolved in the aqueous medium. The aqueous medium may function as a dispersion medium. Dispersoid may be dispersed in the aqueous medium. Examples of polar media that can be used for the aqueous medium include alcohols (specific examples include methanol and ethanol). The aqueous medium has a boiling point of approximately 100° C.

Hereinafter, the term "-based" may be appended to the name of a chemical compound in order to form a generic name encompassing both the chemical compound itself and derivatives thereof. Also, when the term "-based" is appended to the name of a chemical compound used in the name of a polymer, the term indicates that a repeating unit of the polymer originates from the chemical compound or a derivative thereof. The term "(meth)acryl" may be used as a generic term for both acryl and methacryl. The term "(meth) acrylonitrile" may be used as a generic term for both acrylonitrile and methacrylonitrile. The term "hydrophilic functional group" may be used as a generic term for both a functional group capable of forming a salt through ionization and salts thereof. Examples of hydrophilic functional groups include an acid group (more specific examples include a carboxyl group and a sulfo group), a hydroxyl group, and a salt thereof (more specific examples include —COONa, —$SO_3$Na, and —ONa). Subscripts "n" attached to repeating units in chemical formulae each represent, independently of one another, the number of repetitions (the number of moles) of the corresponding repeating unit. The n (number of repetitions) is any number, unless otherwise stated.

The toner according to the present embodiment is a positively chargeable toner and can be favorably used for development of an electrostatic latent image. The toner according to the present embodiment is a powder including a plurality of toner particles (particles each having the later-described features). The toner may be used as a one-component developer. Alternatively, the toner may be mixed with a carrier using a mixer (for example, a ball mill) in order to prepare a two-component developer. In order to achieve high quality image formation, a ferrite carrier is preferably used as the carrier. In order to achieve high quality image formation over an extended period of time, magnetic carrier particles including carrier cores and resin layers coating the carrier cores are preferably used. In order that carrier particles are magnetic, carrier cores thereof may be formed from a magnetic material or formed from a resin in which magnetic particles are dispersed. Preferably, an amount of the toner in the two-component developer is at least 5 parts by mass and no greater than 15 parts by mass relative to 100 parts by mass of the carrier, and more preferably at least 8 parts by mass and no greater than 12 parts by mass, in order to achieve high quality image formation. Note that a positively chargeable toner included in a two-component developer is positively charged by friction against a carrier therein.

The toner particles included in the toner according to the present embodiment each include a core (hereinafter referred to as a toner core) and a shell layer (capsule layer) disposed over a surface of the toner core. The shell layer covers the surface of the toner core. An external additive may adhere to a surface of the shell layer (or a region of the surface of the toner core that is not covered with the shell layer). A plurality of shell layers may alternatively be layered on the surface of the toner core. The external additive may be omitted if unnecessary. Hereinafter, the term toner mother particles is used to refer to toner particles having no external additive. The term shell material is used to refer to a material for formation of the shell layer.

The toner according to the present embodiment can for example be used in image formation in an electrophotographic apparatus (image forming apparatus). The following describes an example of image forming methods that are performed by electrophotographic apparatuses.

First, an electrostatic latent image is formed on a photosensitive member (for example, on a surface of a photosensitive drum) based on image data. Next, the thus formed electrostatic latent image is developed using a developer containing a toner. In the developing step, the toner (for example, the toner charged by friction with a carrier or with a blade) on a development sleeve (for example, a surface of a development roller in a developing device) is caused to adhere to the electrostatic latent image on the photosensitive member such that a toner image is formed on the photosensitive member. Subsequently, in a transfer step, the toner image on the photosensitive member is transferred onto an intermediate transfer member (for example, a transfer belt), and then the toner image on the intermediate transfer member is further transferred onto a recording medium (for example, paper). Next, a fixing device (fixing method: nip fixing using a heating roller and a pressure roller) fixes the toner to the recording medium by applying heat and pressure to the toner. As a result, an image is formed on the recording medium. A full-color image can for example be formed by superimposing toner images of four different colors: black, yellow, magenta, and cyan. The fixing method may be belt fixing.

A dispersion of the toner cores is obtained by dispersing the toner cores in a liquid having the shell material dissolved or dispersed therein. For causing polymerization of the shell material in the dispersion of the toner cores, the toner cores are preferably anionic, whereas the shell layers are preferably cationic. The cationic shell material is electrically attracted toward the anionic toner cores in the dispersion of the toner cores, and thus the shell layers are readily formed on the surfaces of the toner cores through in-situ polymerization. The shell layers can be readily formed in a uniform manner over the surfaces of the toner cores without using a surfactant (or with only a small amount of surfactant).

Zeta potential can be used as an indicator of anionic strength or cationic strength. For example, in a situation in which particles (for example, toner cores or toner mother particles) have a negative zeta potential (less than 0 V) when measured in an aqueous medium adjusted to pH 4 and 23° C., the particles (for example, the toner cores or the toner mother particles) are anionic. The aqueous medium that is used for the zeta potential measurement is preferably ion exchanged water having an electrical conductivity of no greater than 10 μS/cm, and more preferably ion exchanged water having an electrical conductivity of no greater than 1 μS/cm. In order to precisely measure the zeta potential of particles in an aqueous medium, it is preferable that air bubbles are not attached to the surfaces of the particles in the aqueous medium so that the surfaces of the particles become sufficiently wet. Examples of methods for improving wettability of the particles include a method in which an ultrasonic treatment is performed on the aqueous medium including the particles and a method in which a surfactant is added to the aqueous medium. Ions in the aqueous medium are likely to have an influence on measurement values of the zeta potential. It is therefore preferable to use a nonionic surfactant in a range of from 0.1% by mass to 1% by mass in the method in which a surfactant is added to the aqueous medium. Hereinafter, a zeta potential measured in an aqueous medium adjusted to pH x (x being any positive number) and 23° C. may be referred to as "a zeta potential at pH x" or "$\zeta(x)$". When the zeta potential is measured in an aqueous medium at 23° C., a pH of the aqueous medium that gives a zeta potential of 0 V may be referred to as "isoelectric pH".

In a situation in which cationic shell layers are formed on anionic toner cores (for example, toner cores containing a polyester resin as a binder resin), resulting toner mother particles (the toner cores having the shell layers formed thereon) tend to have a greater zeta potential than the toner cores. Furthermore, the zeta potential of particles (for example, toner cores or toner mother particles) measured in an aqueous medium tends to decrease with an increase in the pH of the aqueous medium. In order that the toner cores and the shell layers bond more strongly to one another, the toner cores preferably have a zeta potential at pH 4 of less than 0 V (more preferably no greater than −5 mV) and the toner mother particles preferably have a zeta potential at pH 4 of greater than 0 V.

Examples of methods for measuring the zeta potential include an electrophoresis method, an ultrasound method, and an electric sonic amplitude (ESA) method.

The electrophoresis method involves applying an electrical field to a dispersion of particles, thereby causing electrophoresis of electrically charged particles in the dispersion, and measuring the zeta potential based on the rate of electrophoresis. An example of the electrophoresis method is laser Doppler electrophoresis (a method in which migrating particles are irradiated with laser light and the rate of electrophoresis of the particles is calculated from an amount of Doppler shift of scattered light that is obtained). Advantages of laser Doppler electrophoresis are a lack of necessity for particle concentration in the dispersion to be high, a low number of parameters being necessary for calculating the zeta potential, and a good degree of sensitivity in detection of the rate of electrophoresis.

The following describes the principles of the laser Doppler electrophoresis. Application of an electrical field to a dispersion containing electrically charged particles causes the particles in the dispersion to move toward an electrode.

During the above, the rate of movement (rate of migration) of the particles is proportional to the charge of the particles. Thus, the zeta potential of the particles can be calculated by measuring the rate of movement of the particles. Furthermore, irradiation of migrating particles with laser light causes the frequency of scattered light from the particles to shift because of the Doppler effect. The amount of frequency shift is proportional to the rate of migration of the particles. Thus, the rate of migration of the particles can be calculated by measuring the amount of frequency shift. Electrical mobility U represented by a formula "$U=V/E$" can be calculated from the thus determined rate of migration V and electrical field E. Zeta potential $\zeta$ represented by a formula "$\zeta=4\pi\eta U/\varepsilon$" can be calculated from the thus determined electrical mobility U, viscosity $\eta$ of a solvent, and dielectric constant $\in$ of the solvent.

The ultrasound method involves irradiating a dispersion of particles with ultrasound, thereby causing vibration of electrically charged particles in the dispersion, and measuring the zeta potential based on an electric potential difference that arises due to the vibration. The ESA method involves applying a high frequency voltage to a dispersion of particles, thereby causing electrically charged particles in the dispersion to vibrate and generate ultrasound. The zeta potential is then calculated based on the magnitude (intensity) of the ultrasound. An advantage of the ultrasound method and the ESA method is that the zeta potential can be measured to a good degree of sensitivity even when the dispersion of the particles has a high particle concentration (for example, exceeding 20% by mass) because no optical instrument is used.

The toner according to the present embodiment is a positively chargeable toner that has the following features (1) and (2).

(1) The toner cores contain a polyester resin. Each of the shell layers partially covers a surface of the corresponding toner core. More specifically, each of the shell layers covers at least 40% and no greater than 80% of the surface of the corresponding toner core. Hereinafter, the proportion of the area of a region, of the surface of the toner core, that is covered with the shell layer is referred to as a shell coverage. The shell coverage is measured by a method to be described for Examples or by an alternative method. The shell coverage may be measured before addition of an external additive or after addition of an external additive. The shell coverage of the toner mother particles may be measured after removing the external additive adhering to the toner mother particles. Removal of the external additive from the toner particles may be performed through dissolution of the external additive using a solvent (for example, an alkaline solution). Alternatively, removal of the external additive may be performed using an ultrasonic cleaner.

(2) $\zeta(4)$ of the toner with the toner particles having no external additive (toner mother particles) is greater than 0 V. $\zeta(6)$ of the toner with the toner particles having no external additive (toner mother particles) is less than 0 V. $\zeta(3)$, $\zeta(4)$, $\zeta(6)$, and $\zeta(7)$ of the toner with the toner particles having no external additive (toner mother particles) satisfy a relationship represented by $|\zeta(3)-\zeta(4)|>|\zeta(6)-\zeta(7)|$. Hereinafter, $\zeta(3)$, $\zeta(4)$, $\zeta(6)$, and $\zeta(7)$ of the toner with the toner particles having no external additive (toner mother particles) may be referred to simply as $\zeta(3)$, $\zeta(4)$, $\zeta(6)$, and $\zeta(7)$, respectively. $\zeta(3)$, $\zeta(4)$, $\zeta(6)$, and $\zeta(7)$ are respectively measured in an aqueous medium at pH 3, pH 4, pH 6, and pH 7. The aqueous medium is a medium in which water is a main component. The aqueous medium may contain a pH adjuster (specific examples include hydrochloric acid and sodium hydroxide). $\zeta(3)$, $\zeta(4)$, $\zeta(6)$, and $\zeta(7)$ are measured by a method to be described later or by an alternative method. The zeta potential of the toner with the toner particles having no external additive (zeta potential of the toner mother particles) can be measured after addition of an external additive. For example, the toner with the toner particles having an external additive may be used as a measurement target, and the zeta potential of the toner mother particles thereof may be determined by removing influences of the external additive on the zeta potential. Alternatively, the zeta potential of the toner mother particles may be measured after removing the external additive adhering to the toner mother particles. Removal of the external additive from the toner particles may be performed through dissolution of the external additive using a solvent (for example, an alkaline solution). Alternatively, removal of the external additive may be performed using an ultrasonic cleaner.

The feature (1) is beneficial for achieving both high-temperature preservability and low-temperature fixability of the toner. A too low shell coverage tends to lead to poor high-temperature preservability of the toner. A too high shell coverage tends to lead to poor low-temperature fixability of the toner. The polyester resin is of strong negatively chargeable character. Thus, the toner cores containing a polyester resin tends to be negatively chargeable. However, the toner having the feature (1) has a shell coverage of at least 40%, and therefore the toner cores are not exposed too much, allowing the toner to be positively charged in a stable manner even if the toner cores contain a polyester resin.

The feature (2) is beneficial for improving quality of images to be formed using the toner having the feature (1) (particularly, for reducing fogging). The zeta potential of the toner mother particles tends to vary depending on conditions of coverage of the toner core surfaces by the shell layers (specific examples include the shell coverage, the thickness of the shell layers, and the film quality of the shell layers). The inventor has found that a profile of the zeta potential (particularly, an amount of change in the zeta potential) depending on pH change has a significant influence on chargeability of the toner (see Tables 2 and 3 described later). More specifically, adhesion between the toner cores and the shell layers tends to be strong in a situation in which an amount of change $|\zeta(3)-\zeta(4)|$ in the zeta potential at lower pHs (hereinafter referred to as a first amount of change) is greater than an amount of change $|\zeta(6)-\zeta(7)|$ in the zeta potential at higher pHs (hereinafter referred to as a second amount of change). The inventor has also found that the second amount of change indicates density of the shell layers. A smaller second amount of change tends to provide denser shell layers. Furthermore, in a situation in which the first amount of change is greater than the second amount of change, the shell layers tend not to rupture even when the toner is subjected to stress while being mixed with a developer carrier. As a result, the toner tends not to scatter and tends not to cause fogging in images that are formed using the toner even if consumption and replenishment of the toner are repeated.

It is thought that thin and uniform shell layers are readily formed on the surfaces of the toner cores as a result of the toner having the aforementioned features (1) and (2). Furthermore, it is thought that the thin and uniform shell layers formed on the surfaces of the toner cores improve durability and fixability of the toner to enable preferable image formation.

FIGURE illustrates an example of a profile of the zeta potential of the toner mother particles in the toner having the features (1) and (2). With respect to the profile of the zeta potential represented by a line L1 in FIGURE, the isoelectric pH is greater than 4 and less than 6. The zeta potential decreases with an increase in the pH. A ratio of change in the zeta potential relative to the pH (a ratio of decrease in the zeta potential relative to increase in the pH) decreases with an increase in the pH.

The following describes, in order, the toner cores (a binder resin and internal additives), the shell layers, and external additives. Non-essential components (for example, an internal additive or an external additive) may be omitted in accordance with the intended use of the toner.

<Suitable Thermoplastic Resins>

Examples of thermoplastic resins that can be preferably used to form the toner particles (particularly the toner cores and the shell layers) include styrene-based resins, acrylic acid-based resins (specific examples include acrylic acid ester polymers and methacrylic acid ester polymers), olefin-based resins (specific examples include polyethylene resins and polypropylene resins), vinyl chloride resins, polyvinyl alcohol, vinyl ether resins, N-vinyl resins, polyester resins, polyamide resins, and urethane resins. Furthermore, copolymers of the resins listed above, that is, copolymers obtained through incorporation of a repeating unit into any of the resins listed above (specific examples include styrene-acrylic acid-based resins and styrene-butadiene-based resins) may be preferably used as the thermoplastic resin to form the toner particles.

A thermoplastic resin is obtained through addition polymerization, copolymerization, or condensation polymerization of at least one thermoplastic monomer. The thermoplastic monomer is a monomer that forms a thermoplastic resin through homopolymarization (specific examples include an acrylic acid-based monomer and a styrene-based monomer) or a monomer that forms a thermoplastic resin through condensation polymerization (for example, a combination of a polyhydric alcohol and a polycarboxylic acid that forms a polyester resin through condensation polymerization).

A polyester resin can be obtained through condensation polymerization of at least one polyhydric alcohol and at least one polycarboxylic acid. Examples of alcohols that can be preferably used in synthesis of the polyester resin include dihydric alcohols specific examples include diols and bisphenols and tri- or higher-hydric alcohols shown below Examples of carboxylic acids that can be preferably used in synthesis of the polyester resin include di-, tri-, and higher-basic carboxylic acids shown below. The acid value and the hydroxyl value of the polyester resin can be adjusted through adjustment of the amount of the alcohol and the amount of the carboxylic acid used in synthesis of the polyester resin. Increasing the molecular weight of the polyester resin tends to decrease the acid value and the hydroxyl value of the polyester resin.

Examples of preferable diols include ethylene glycol, diethylene glycol, triethylene glycol, 1,2-propanediol, 1,3-propanediol, 2-butene-1,4-diol, neopentyl glycol, 1,4-butanediol, 1,5-pentanediol, 1,6-hexanediol, 1,4-cyclohexanedimethanol, dipropylene glycol, polyethylene glycol, polypropylene glycol, and polytetramethylene glycol.

Examples of preferable bisphenols include bisphenol A, hydrogenated bisphenol A, bisphenol A ethylene oxide adduct, and bisphenol A propylene oxide adduct.

Examples of preferable tri- or higher-hydric alcohols include sorbitol, 1,2,3,6-hexanetetraol, 1,4-sorbitan, pentaerythritol, dipentaerythritol, tripentaerythritol, 1,2,4-butanetriol, 1,2,5-pentanetriol, glycerol, diglycerol, 2-methylpropanetriol, 2-methyl-1,2,4-butanetriol trimethylolethane, trimethylolpropane, and 1,3,5-trihydroxymethylbenzene.

Examples of preferable di-basic carboxylic acids include maleic acid, fumaric acid, citraconic acid, itaconic acid, glutaconic acid, phthalic acid, isophthalic acid, terephthalic acid, cyclohexanedicarboxylic acid, adipic acid, sebacic acid, azelaic acid, malonic acid, succinic acid, alkyl succinic acids (specific examples include n-butyl succinic acid, isobutylsuccinic acid, n-octylsuccinic acid, n-dodecylsuccinic acid, and isododecylsuccinic acid), and alkenyl succinic acids (specific examples include n-butenylsuccinic acid, isobutenylsuccinic acid, n-octenylsuccinic acid, n-dodecenylsuccinic acid, and isododecenylsuccinic acid).

Examples of preferable tri- or higher-basic carboxylic acids include 1,2,4-benzenetricarboxylic acid (trimellitic acid), 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, and EMPOL trimer acid.

Alternatively, an ester-forming derivative (specific examples include an acid halide, acid anhydride, or lower alkyl ester) of any of the di-, tri-, or higher-basic carboxylic acids listed above may be used. Hereinafter, the term "lower alkyl" refers to an alkyl group having 1 to 6 carbon atoms.

<Suitable Thermosetting Resins>

Examples of thermosetting resins that can be preferably used to form the toner particles (particularly the shell layers) include aminoaldehyde resins, polyimide resins (specific examples include maleimide polymers and bismaleimide polymers), and xylene-based resins. An aminoaldehyde resin is a resin generated through condensation polymerization of an aldehyde (for example, formaldehyde) and a compound having an amino group. Examples of aminoaldehyde resins include melamine-based resins, urea-based resins, sulfonamide-based resins, glyoxal-based resins, guanamine-based resin, and aniline-based resins.

A thermosetting resin is obtained through a cross-linking reaction (polymerization) of at least one thermosetting monomer. Furthermore, use of a cross-linking agent enables synthesis of a thermosetting resin from a thermoplastic monomer. The thermosetting monomer is a cross-linking monomer. For example, when molecules of one species of monomer are three-dimensionally linked through "—$CH_2$—" to form a thermosetting resin, the monomer is a "thermosetting monomer". For more specific example, melamine, which is used for synthesis of a melamine resin, is a "thermosetting monomer".

Examples of preferable thermosetting monomers include methylol melamine, melamine, methylol urea (specific examples include dimethylol dihydroxyethyleneurea), urea, benzoguanamine, acetoguanamine, and spiroguanamine. For synthesizing an aminoaldehyde resin, use of a methylolated compound as a raw material (a monomer or a prepolymer) of the resin enables promotion of synthesis (polymerization reaction) of the resin without addition of aldehyde.

[Toner Core]

The toner cores contain a binder resin. The toner cores may further contain internal additives (for example, a colorant, a releasing agent, a charge control agent, and a magnetic powder).

(Binder Resin)

Typically, the binder resin is a main component (for example, at least 85% by mass) of the toner cores. Accordingly, properties of the binder resin are thought to have a great influence on overall properties of the toner cores. For example, the toner cores have a higher tendency to be anionic in a situation in which the binder resin has an ester group, a hydroxyl group, an ether group, an acid group, or a methyl group, and have a higher tendency to be cationic in a situation in which the binder resin has an amino group or an amide group. In order to increase reactivity of the toner cores with the shell layers, the binder resin preferably has a hydroxyl value (measured according to Japanese Industrial Standard (JIS) K-0070-1992) and an acid value (measured according to Japanese Industrial Standard (JIS) K-0070-1992) that are each at least 10 mg KOH/g, and more preferably at least 2.0 mg KOH/g.

The binder resin is preferably a resin having at least one chemical group selected from the group consisting of an ester group, a hydroxyl group, an ether group, an acid group, and a methyl group, and more preferably a resin having either or both of a hydroxyl group and a carboxyl group. The binder resin having a functional group such as listed above readily reacts to form chemical bonds with the shell material. Formation of chemical bonds ensures that the toner cores are strongly bound to the shell layers. Furthermore, the binder resin preferably has an activated hydrogen-containing functional group in molecules thereof.

In order to improve fixability of the toner in high speed fixing, the binder resin preferably has a glass transition point (Tg) of at least 20° C. and no greater than 55° C. In order to improve fixability of the toner in high speed fixing, the binder resin preferably has a softening point (Tm) of no greater than 100° C. Tg and Tm are measured by methods to be described for Examples or by alternative methods. Either or both of Tg and Tm of a resin can be adjusted by changing the species or the amount of components (monomers) of the resin. Either or both of Tg and Tm of the binder resin can be also adjusted by combining a plurality of resins.

The toner according to the present embodiment has the aforementioned feature (1). The toner cores in the toner according to the present embodiment contain at least one polyester resin. The toner cores may contain only a polyester resin as the binder resin or may contain a resin other than the polyester resin (hereinafter referred to as an additional binder resin) as the binder resin. The additional binder resin is preferably any of the "preferable thermoplastic resins" listed above, and particularly preferably a styrene-acrylic acid-based resin. In order to improve colorant dispersibility in the toner cores, chargeability of the toner, and fixability of the toner to a recording medium, the toner cores preferably contain only a polyester resin as the binder resin. In order to obtain a toner having excellent low-temperature fixability, the polyester resin preferably accounts for at least 80% by mass of the resin contained in the toner core, more preferably at least 90% by mass of the resin, and still more preferably 100% by mass of the resin.

Examples of preferable polyester resins include a polymer of at least one bisphenol (specific examples include bisphenol A ethylene oxide adduct and bisphenol A propylene oxide adduct) and at least one dicarboxylic acid (specific examples include terephthalic acid, fumaric acid, and alkyl succinic acid).

In a situation in which the polyester resin is used as the binder resin of the toner cores, the polyester resin preferably has a number average molecular weight (Mn) of at least 1,000 and no greater than 2,000 in order to improve toner core strength and toner fixability. The polyester resin preferably has a molecular weight distribution (ratio Mw/Mn of mass average molecular weight (Mw) to number average molecular weight (Mn)) of at least 9 and no greater than 21. Mn and Mw of the polyester resin can be measured by gel permeation chromatography.

(Colorant)

The toner cores may contain a colorant. A known pigment or dye matching a color of the toner can be used as a colorant. In order to achieve high quality image formation using the toner, the amount of the colorant is preferably at least 1 part by mass and no greater than 20 parts by mass relative to 100 parts by mass of the binder resin, and more preferably at least 3 parts by mass and no greater than 10 parts by mass.

The toner cores may contain a black colorant. Carbon black can for example be used as a black colorant. Alternatively, a colorant that is adjusted to a black color using a yellow colorant, a magenta colorant, and a cyan colorant can be used as a black colorant.

The toner cores may include a non-black colorant such as a yellow colorant, a magenta colorant, or a cyan colorant.

The yellow colorant that can be used is for example at least one compound selected from the group consisting of condensed azo compounds, isoindolinone compounds, anthraquinone compounds, azo metal complexes, methine compounds, and arylamide compounds. Examples of yellow colorants that can be preferably used include C.I. Pigment Yellow (3, 12, 13, 14, 15, 17, 62, 74, 83, 93, 94, 95, 97, 109, 110, 111, 120, 127, 128, 129, 147, 151, 154, 155, 168, 174, 175, 176, 180, 181, 191, or 194), Naphthol Yellow S, Hansa Yellow G, and C.I. Vat Yellow.

The magenta colorant that can be used is for example at least one compound selected from the group consisting of condensed azo compounds, diketopyrrolopyrrole compounds, anthraquinone compounds, quinacridone compounds, basic dye lake compounds, naphthol compounds, benzimidazolone compounds, thioindigo compounds, and perylene compounds. Examples of magenta colorants that can be preferably used include C.I. Pigment Red (2, 3, 5, 6, 7, 19, 23, 48:2, 48:3, 48:4, 57:1, 81:1, 122, 144, 146, 150, 166, 169, 177, 184, 185, 202, 206, 220, 221, or 254).

The cyan colorant that can be used is for example at least one compound selected from the group consisting of copper phthalocyanine compounds, anthraquinone compounds, and basic dye lake compounds. Examples of cyan colorants that can be preferably used include C.I. Pigment Blue (1, 7, 15, 15:1, 15:2, 15:3, 15:4, 60, 62, or 66), Phthalocyanine Blue, C.I. Vat Blue, and C.I. Acid Blue.

(Releasing Agent)

The toner cores may contain a releasing agent. The releasing agent is for example used in order to improve fixability or offset resistance of the toner. In order to increase the anionic strength of the toner cores, the toner cores are preferably prepared using an anionic wax. In order to improve taxability or offset resistance of the toner, the amount of the releasing agent is preferably at least 1 part by mass and no greater than 30 parts by mass relative to 100 parts by mass of the binder resin, and more preferably at least 5 parts by mass and no greater than 20 parts by mass.

Examples of releasing agents that can be preferably used include: aliphatic hydrocarbon waxes such as low molecular weight polyethylene, low molecular weight polypropylene, polyolefin copolymer, polyolefin wax, microcrystalline wax, paraffin wax, and Fischer-Tropsch wax; oxides of aliphatic hydrocarbon waxes such as polyethylene oxide wax and block copolymer of polyethylene oxide wax; plant waxes such as candelilla wax, carnauba wax, Japan wax, jojoba wax, and rice wax; animal waxes such as beeswax, lanolin, and spermaceti; mineral waxes such as ozokerite, ceresin, and petrolatum; waxes having a fatty acid ester as a main component such as montanic acid ester wax and castor wax; and waxes in which a fatty acid ester is partially or fully deoxidized such as deoxidized carnauba wax. One releasing agent may be used independently, or two or more releasing agents may be used in combination.

In order to improve compatibility between the binder resin and the releasing agent, a compatibilizer may be added to the toner cores.

(Charge Control Agent)

The toner cores may contain a charge control agent. The charge control agent is for example used in order to improve charge stability or a charge rise characteristic of the toner. The charge rise characteristic of the toner is an indicator as to whether the toner can be charged to a specific charge level in a short period of time.

The anionic strength of the toner cores can be increased by including a negatively chargeable charge control agent (specific examples include organic metal complexes and chelate compounds) in the toner cores. The cationic strength of the toner cores can be increased by including a positively chargeable charge control agent (specific examples include pyridine, nigrosine, and quaternary ammonium salts) in the toner cores. However, when it is ensured that the toner has sufficient chargeability, the toner cores do not need to contain a charge control agent.

(Magnetic Powder)

The toner cores may contain a magnetic powder. Examples of materials of the magnetic powder that can be preferably used include ferromagnetic metals (specific examples include iron, cobalt, nickel, and alloys of any one or two of the aforementioned metals), ferromagnetic metal oxides (specific examples include ferrite, magnetite, and chromium dioxide), and materials subjected to ferromagnetization (specific examples include carbon materials made ferromagnetic through thermal treatment). One magnetic powder may be used independently, or two or more magnetic powders may be used in combination.

The magnetic powder is preferably subjected to surface treatment in order to inhibit elution of metal ions (for example, iron ions) from the magnetic powder. In a situation in which the shell layers are formed on the surfaces of the toner cores under acidic conditions, elution of metal ions to the surfaces of the toner cores causes the toner cores to adhere to one another more readily. It is thought that inhibiting elution of metal ions from the magnetic powder thereby inhibits the toner cores from adhering to one another.

[Shell Layer]

The shell layers may be grainy films or may be non-grainy films. Resin particles may be used as a material for forming the shell layers. It is thought that non-grainy films are formed as the shell layers in a situation in which the material (resin particles) is caused to completely melt and hardened into a film form. On the other hand, it is thought that films each formed from rows of two-dimensionally arranged resin particles (grainy films) are formed as the shell layers in a situation in which the material (resin particles) is caused not to completely melt and hardened into a film form. Each of the shell layers is not necessarily a continuous layer. Each of the shell layers may be one film, may be a collection of a plurality of spaced-apart films (islands), or may include both the resin particles and the resin film.

The shell layers may substantially consist only of a thermosetting resin (specific examples include the "suitable thermosetting resins" listed above), may substantially consist only of a thermoplastic resin (specific examples include the "suitable thermoplastic resins" listed above), or may include both a thermosetting resin and a thermoplastic resin. In a situation in which the shell layers include both a thermosetting resin and a thermoplastic resin, the ratio between the thermoplastic resin and the thermosetting resin in the shell layers is determined as appropriate. The ratio between the thermoplastic resin and the thermosetting resin is for example 1:1, 1:2, 1:3, 1:4, 1:5, 2:1, 3:1, 4:1, or 5:1 (mass ratio, thermoplastic resin:thermosetting resin).

In order to improve high-temperature preservability of the toner, the shell layers preferably contain any of the "suitable thermosetting resins" listed above. Particularly preferably, the shell layers contain at least one thermosetting resin selected from the group consisting of a melamine-based resin, a urea-based resin, and a glyoxal-based resin, in order to improve charge stability and high-temperature preservability of the toner. The shell layers may for example further contain a thermosetting resin in addition to a hydrophobic resin and a chargeable resin to be described later.

In order to adjust the zeta potential of the toner mother particles so as to satisfy the requirement described as the feature (2), the shell layers preferably contain at least two resins. The chargeability of the shell layers and thus also the zeta potential of the toner mother particles) is readily adjusted by combining a plurality of resins. In order that the toner has the feature (2) while maintaining excellent charge stability, the shell layers of the toner preferably contain a first resin and a second resin. The first resin is of stronger hydrophobic character than the second resin. The second resin is of stronger positively chargeable character than the first resin. Hereinafter, the first resin contained in the shell layers is referred to as a hydrophobic resin. The second resin contained in the shell layers is referred to as a chargeable resin.

It is thought that as a result of the shell layers having the hydrophobic resin, the surfaces of the toner particles tend not to absorb moisture, improving charge stability of the toner in a high-temperature and high-humidity environment. The zeta potential of the toner mother particles can be easily adjusted by adjusting the blending ratio between the hydrophobic resin and the chargeable resin. The zeta potential of the toner mother particles can also be adjusted by adjusting the proportion (mole fraction) of a repeating unit derived from a positively chargeable charge control agent in the chargeable resin.

In order to ensure sufficient positive chargeability and charge stability of the toner, the shell layers preferably include a plurality of particles of the chargeable resin and a film of the hydrophobic resin present between the particles. In a situation in which the glass transition point (Tg) of the chargeable resin is higher than the glass transition point (Tg) of the hydrophobic resin by at least 15° C. (Tg of chargeable resin−Tg of hydrophobic resin≥15° C.), it is easy to form the shell layers including the particles of the chargeable resin and the film of the hydrophobic resin. Particularly preferably, the glass transition point (Tg) of the hydrophobic resin is at least 65° C. and no greater than 80° C., and the glass transition point (Tg) of the chargeable resin is at least 95° C. and no greater than 120° C.

In order to obtain the shell layers having suitable strength, the chargeable resin and the hydrophobic resin preferably include a repeating unit derived from a common monomer. The repeating unit derived from the common monomer allows strength of bonding between the chargeable resin and the hydrophobic resin to be locally increased. The common monomer refers to one species of monomer common to the chargeable resin and the hydrophobic resin. The species of a monomer is for example identified according to a CAS registry number. One species of monomer can be represented by one chemical formula. In a situation in which both the chargeable resin and the hydrophobic resin include a repeating unit derived from n-butyl acrylate, for example, it means that the chargeable resin and the hydrophobic resin include the repeating unit derived from the common monomer (n-butyl acrylate).

The hydrophobic resin is preferably a resin including at least one repeating unit derived from a styrene-based monomer (for example, a repeating unit represented by formula (1) shown below).

[Formula 1]

(1)

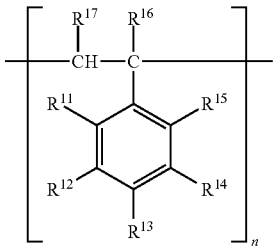

In formula (1), $R^{11}$ to $R^{15}$ each represent, independently of one another, a hydrogen atom, a halogen atom, a hydroxyl group, an optionally substituted alkyl group, an optionally substituted alkoxy group, or an optionally substituted aryl group. $R^{16}$ and $R^{17}$ each represent, independently of one another, a hydrogen atom, a halogen atom, or an optionally substituted alkyl group. Preferably, $R^{11}$ to $R^{15}$ each represent, independently of one another, a hydrogen atom, a halogen atom, an alkyl group having a carbon number of at least 1 and no greater than 4, an alkoxy group having a carbon number of at least 1 and no greater than 4, or an alkoxyalkyl group having a carbon number (more specifically, a total carbon number of alkoxy and alkyl) of at least 2 and no greater than 6. Preferably, $R^{16}$ and $R^{17}$ each represent, independently of one another, a hydrogen atom or a methyl group. Particularly preferably, $R^{16}$ and $R^{17}$ are a combination of $R^{17}$ representing a hydrogen atom and $R^{16}$ representing a hydrogen atom or a methyl group. In the repeating unit derived from styrene, $R^{11}$ to $R^{17}$ each represent a hydrogen atom.

In order that the shell layers have a sufficiently strong hydrophobic character and suitable strength, the hydrophobic resin is preferably a copolymer of at least one styrene-based monomer and at least one acrylic acid-based monomer (specific examples include (meth)acrylonitrile, alkyl (meth) acrylates, and hydroxyalkyl (meth)acrylates). Styrene-acrylic acid-based resins tend to be of stronger hydrophobic character and more positively chargeable than polyester resins.

In order that the shell layers have a sufficiently strong hydrophobic character and suitable strength, it is preferable that a repeating unit having the highest mole fraction of the repeating units included in the hydrophobic resin is a repeating unit derived from a styrene-based monomer.

In order to sufficiently inhibit adsorption of moisture in the air to the surfaces of the toner particles, the proportion of a repeating unit having a hydrophilic functional group is preferably no greater than 10% by mass among all the repeating units included in the hydrophobic resin. Particularly preferably, the proportion is 0% by mass (the hydrophobic resin includes no repeating unit having a hydrophilic functional group).

The chargeable resin is preferably a resin including at least one repeating unit derived from a nitrogen-free vinyl compound and at least one repeating unit derived from a nitrogen-containing vinyl compound (specific examples include quaternary ammonium compounds and pyridine compounds). The vinyl compound refers to a compound having a vinyl group ($CH_2{=}CH{-}$) or a substituted vinyl group in which hydrogen is replaced (specific examples include ethylene, propylene, butadiene, vinyl chloride, acrylic acid, methyl acrylate, methacrylic acid, methyl methacrylate, acrylonitrile, and styrene). The vinyl compound can be formed into a polymer (resin) by addition polymerization through carbon-to-carbon double bonds "C=C" each included in the vinyl group or the substituted vinyl group.

In order that the shell layers have sufficiently strong chargeability, the chargeable resin preferably includes a repeating unit derived from a quaternary ammonium compound as the repeating unit derived from a nitrogen-containing vinyl compound, and particularly preferably includes a repeating unit represented by formula (2) shown below or a salt thereof. The quaternary ammonium compound is a compound having a quaternary ammonium cation ($N^+$). Examples of nitrogen-containing vinyl compounds other than quaternary ammonium compounds include 4-vinyl pyridine.

[Formula 2]

(2)

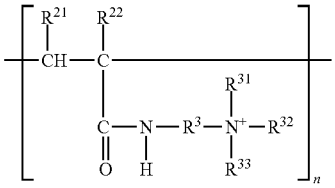

In formula (2), $R^{21}$ and $R^{22}$ each represent, independently of one another, a hydrogen atom, a halogen atom, or an optionally substituted alkyl group. $R^{31}$, $R^{32}$, and $R^{33}$ each represent, independently of one another, a hydrogen atom, an optionally substituted alkyl group, or an optionally substituted alkoxy group. $R^3$ represents an optionally substituted alkylene group. Preferably, $R^{21}$ and $R^{22}$ each represent, independently of one another, a hydrogen atom or a methyl group. Particularly preferably, $R^{21}$ and $R^{22}$ are a combination of $R^{21}$ representing a hydrogen atom and $R^{22}$ representing a hydrogen atom or a methyl group. Preferably, $R^{31}$, $R^{32}$, and $R^{31}$ each represent, independently of one another, an alkyl group having a carbon number of at least 1 and no greater than 8, and particularly preferably a methyl group, an ethyl group, an n-propyl group, an iso-propyl group, an n-butyl group, or an iso-butyl group. $R^3$ preferably represents an alkylene group having a carbon number of at least 1 and no greater than 6, and particularly preferably an ethylene group or a propylene group. In a repeating unit derived from dimethylaminopropyl acrylamide methyl chloride quaternary salt. $R^{21}$ and $R^{22}$ each represent a hydrogen atom, $R^3$ represents a propylene group ($-(CH_2)_3-$), and $R^{31}$ to $R^{33}$ each represent a methyl group. A salt thereof is formed through ionic bonding between a quaternary ammonium cation ($N^+$) and chlorine (Cl).

In order that the shell layers have sufficiently strong chargeability and suitable strength, the chargeable resin is preferably a copolymer of at least one quaternary ammonium compound and at least one (meth)acrylic acid ester (specific examples include methyl (meth)acrylate, ethyl (meth)acrylate, propyl (meth)acrylate, and butyl (meth)acrylate). Particularly preferably, the chargeable resin is a copolymer of at least one quaternary ammonium compound, at least one alkyl methacrylate, and at least one alkyl acrylate.

In order to improve chargeability of the toner, the shell layers preferably include particles of the chargeable resin (particles that are substantially composed of the chargeable resin). In a situation in which the shell layers include the particles of the chargeable resin, the toner particles are readily charged by friction against a carrier. In order that the toner panicles are positively chargeable, the shell layers include positively chargeable resin particles. The chargeable resin is for example a resin including a positively chargeable charge control agent. The following shows examples of positively chargeable charge control agents that can be preferably used for synthesis of the chargeable resin. Note that a derivative or a salt of any of the compounds listed below may be used as necessary.

Examples of positively chargeable charge control agents that can be preferably used include azine compounds such as pyridazine, pyrimidine, pyrazine, 1,2-oxazine, 1,3-oxazine, 1,4-oxazine, 1,2-thiazine, 1,3-thiazine, 1,4-thiazine, 1,2,3-triazine, 1,2,4-triazine, 1,3,5-triazine, 1,2,4-oxadiazine, 1,3,4-oxadiazine, 1,2,6-oxadiazine, 1,3,4-thiadiazine, 1,3,5-thiadiazine, 1,2,3,4-tetrazine, 1,2,4,5-tetrazine, 1,2,3,5-tetrazine, 1,2,4,6-oxatriazine, 1,3,4,5-oxatriazine, phthalazine, quinazoline, and quinoxaline; direct dyes such as Azine Fast Red FC, Azine Fast Red 123K, Azine Violet BO, Azine Brown 3G, Azine Light Brown GR, Azine Dark Green BH/C, Azine Deep Black EW, and Azine Deep Black 3RL; acid dyes such as Nigrosine BK, Nigrosine NB, and Nigrosine Z; metal salts of naphthenic acids and metal salts of higher organic carboxylic acid; alkoxylated amines; alkylamides; and quaternary ammonium salts such as benzyldecylhexylmethyl ammonium chloride, decyltrimethyl ammonium chloride, 2-(methacryloyloxy) ethyltrimethylammonium chloride, and dimethylaminopropyl acrylamide methyl chloride quaternary salt.

[External Additive]

An external additive (more specifically, a powder including a plurality of external additive particles) may be caused to adhere to the surfaces of the toner mother particles. For example, the toner mother particles (powder) and the external additive (powder) are stirred together, so that the external additive adheres to the surfaces of the toner mother particles by physical force (physical connection). The external additive is for example used in order to improve fluidity or handleability of the toner. In order to improve fluidity or handleability of the toner, the amount of the external additive is preferably at least 0.5 parts by mass and no greater than 10 parts by mass relative to 100 parts by mass of the toner mother particles. Furthermore, in order to improve fluidity or handleability of the toner, the external additive preferably has a particle diameter of at least 0.01 μm and no greater than 1.0 μm.

As the external additive particles, silica particles or particles of a metal oxide (specific examples include alumina, titanium oxide, magnesium oxide, zinc oxide, strontium titanate, and barium titanate) can be preferably used. One external additive may be used independently, or two or more external additives may be used in combination.

[Toner Production Method]

The following describes an example of a method for producing the toner according to the present embodiment, which has the aforementioned features. First, toner cores are prepared. Next, the toner cores and a shell material are added to a liquid. In order to form homogeneous shell layers, the shell material is preferably dissolved or dispersed in the liquid through for example stirring of the liquid containing the shell material. Next, the shell material is caused to react in the liquid to form a shell layer (hardened film) on the surface of each toner core. In order to inhibit dissolution or elution of the toner core materials (in particular, the binder resin and the releasing agent) during the formation of the shell layers, the formation of the shell layers is preferably carried out in an aqueous medium.

The following further describes the method for producing the toner according to the present embodiment based on a more specific example.

(Preparation of Toner Cores)

In order to readily obtain suitable toner cores, the toner cores are preferably prepared by an aggregation method or a pulverization method, and more preferably prepared by a pulverization method.

The following describes an example of the pulverization method. First, a binder resin and an internal additive (for example, at least one of a colorant, a releasing agent, a charge control agent, and a magnetic powder) are mixed. Next, the resultant mixture is melt-kneaded. Next, the resultant melt-kneaded product is pulverized and classified. As a result, toner cores having a desired particle diameter are obtained.

The following describes an example of the aggregation method. First, fine particles of a binder resin, a releasing agent, and a colorant are caused to aggregate in an aqueous medium until the particles have a desired particle diameter. Through the above, aggregated particles containing the binder resin, the releasing agent, and the colorant are formed. Next, the resultant aggregated particles are heated to cause components of the aggregated particles to coalesce. As a result, a dispersion of toner cores is obtained. Next, non-essential substances (for example, surfactant) are removed from the dispersion of the toner cores to yield the toner cores.

(Shell Layer Formation)

As the aqueous medium to which the toner cores and the shell material are to be added, ion exchanged water is for example prepared. Next, hydrochloric acid is for example used to adjust pH of the aqueous medium (for example, a pH selected from a range of from 3 to 5). Next, the toner cores, a suspension of the hydrophobic resin (a liquid containing particles of the hydrophobic resin), and a suspension of the positively chargeable resin (a liquid containing particles of the positively chargeable resin) are added into the pH adjusted aqueous medium (for example, acidic aqueous medium). A material for synthesizing a thermosetting resin may be added to the aqueous medium as necessary.

The aforementioned materials including the shell material may be added to the aqueous medium at room temperature or may be added to the aqueous medium adjusted to a specific temperature. An appropriate amount of the shell material can be calculated based on the specific surface area of the toner cores. A polymerization accelerator may be added to the aqueous medium in addition to the shell material.

In order that the shell material adheres to the surfaces of the toner cores in a uniform manner, a high degree of dispersion of the toner cores is preferably achieved in the liquid containing the shell material. In order to achieve a high degree of dispersion of the toner cores in the liquid, a surfactant may be added to the liquid, or the liquid may be stirred using a powerful stirrer (for example, "Hivis Disper Mix", product of PRIMIX Corporation). In a situation in which the toner cores are anionic, aggregation of the toner cores can be inhibited by using an anionic surfactant having the same polarity. Examples of surfactants that can be used include sulfate ester salt surfactants, sulfonic acid salt surfactants, phosphate acid ester salt surfactants, and soaps.

Next, the liquid containing the materials including the shell material is heated under stirring up to a target temperature (for example, a temperature selected from a range of from 45° C. to 85° C.) at a specific rate (for example, a rate selected from a range of from 0.1° C./minute to 3° C./minute). Furthermore, the liquid is maintained at the target temperature under stirring for a specific period of time (for example, a period of time selected from a range from 30 minutes to 4 hours). It is thought that a reaction between the toner cores and the shell material (fixation of the shell layers) proceeds while the liquid is maintained at the high temperature (or while the liquid is being heated). Either or both of the particles of the hydrophobic resin and the particles of the positively chargeable resin can be prevented from melting and maintained as particles, or can be caused to melt and hardened into a film form by adjusting the target temperature, Tg of the hydrophobic resin, and Tg of the positively chargeable resin. Non-grainy films can be formed by causing the resin particles to completely melt before hardening. In a situation in which only the particles of the hydrophobic resin, among the particles of the hydrophobic resin and the particles of the positively chargeable resin, are caused to melt, for example, it is thought that the melted particles of the hydrophobic resin come in contact with one another and join together to form the respective films. Meanwhile, it is thought that the unmelted particles of the positively chargeable resin are maintained as particles and are present on the surfaces of the toner cores. Through the above, a shell layer including a plurality of particles of the positively chargeable resin and a film of the hydrophobic resin present between the particles can be formed on the surface of each toner core.

The roundness of the toner mother particles can be adjusted by adjusting at least one of the target temperature and the period of time of maintaining at the target temperature. In order to prevent elution of the toner core materials or transformation of the toner cores in shape, the target temperature is preferably lower than the glass transition point (Tg) of the toner cores. However, the toner cores may be purposely caused to transform in shape by setting the target temperature to a temperature higher than the glass transition point (Tg) of the toner cores. The toner cores transform in shape more readily with increasing target temperature, thereby tending to yield toner mother particles that are more spherical. Preferably, the target temperature is adjusted so that the toner mother particles have a desired shape. The shell layers tend to be hard as a result of the shell material being caused to react at a high temperature. The molecular weight of the shell layers can also be controlled based on the target temperature.

After the shell layers are formed as described above, the dispersion of the toner mother particles is neutralized using for example sodium hydroxide. Next, the dispersion of the toner mother panicles is cooled to for example room temperature (approximately 25° C.). Next, the dispersion of the toner mother particles is filtered using for example a Buchner funnel. Through the above, the toner mother particles are separated from the liquid (solid-liquid separation), and thus a wet cake of the toner mother particles is obtained. Next, the resultant wet cake of the toner mother particles is washed. Next, the washed toner mother particles are dried. Next, as necessary, the toner mother particles and an external additive may be mixed using a mixer (for example, an FM mixer, product of Nippon Coke & Engineering Co., Ltd.) to cause the external additive to adhere to the surfaces of the toner mother particles. Note that in a situation in which a spray dryer is used in the drying process, the external additive addition process can be performed at the same time as the drying process by spraying a dispersion of an external additive (for example, silica particles) to the toner mother particles. Thus, a toner including a plurality of toner particles is produced.

Procedures and the order of the processes in the above-described toner production method may be changed as appropriate in accordance with desired structure or properties of the toner. For example, pH of the liquid (for example, the aqueous medium) may be adjusted before or after the materials including the shell material (for example, the shell material and the toner cores) are added to the liquid. The materials including the shell material may be added at the same time or added separately. The process of heating the liquid to the target temperature may be performed before the process of adding the materials including the shell material to the liquid. For causing a reaction of a material (for example, the shell material) in a liquid, the material may be caused to react in the liquid for a specific period of time after the material is added to the liquid, or the material may be caused to react in the liquid while the material is being added to the liquid over a long period of time. The shell material may be added to the liquid as a single addition or may be divided up and added to the liquid as a plurality of additions. The shell layers may be formed by any method. For example, the shell layers may be formed according to an in-situ polymerization process, an in-liquid curing film coating process, or a coacervation process. The toner may be sifted after the external additive addition process. Furthermore, non-essential processes may be omitted. In a situation in which a commercially available product can be used as is as a material, for example, a process of preparing the material can be omitted by using the commercially available product. In a situation in which the reaction for formation of the shell layers proceeds favorably without pH of the liquid being adjusted, the process of adjusting the pH may be omitted. In a situation in which an external additive is not necessary, the external additive addition process may be omitted. In a situation in which an external additive is not caused to adhere to the surfaces of the toner mother particles (the external additive addition process is omitted), the toner mother particles are equivalent to the toner particles. A prepolymer may be used instead of a monomer as a material for synthesizing a resin as necessary. In order to obtain a specific compound, a salt, an ester, a hydrate, or an anhydride of the compound may be used as a material thereof. Each material may be in a solid state or in a liquid state when used. For example, may be used a powder of a material in a solid state, a material worked into a resin (for example, a masterbatch), a material in the form of a solution (a material in a liquid state, being dissolved in a solvent), or a material in the form of a dispersion (a liquid in which a material in a solid state is dispersed). Preferably, a large number of the toner particles are formed at the same time in order that the toner can be produced efficiently.

EXAMPLES

Examples of the present invention will be described. Table 1 shows toners (electrostatic latent image developing, positively chargeable toners) A-1 to A-3, B-1 to B-3, C-1, C-2, D, E, F, and G according to Examples or Comparative Examples.

TABLE 1

| Toner | Shell material A [g] | B [g] | C [mL] |
|---|---|---|---|
| A-1 | 46.0 | 1.92 | — |
| A-2 | 36.8 | 1.92 | — |
| A-3 | 18.4 | 1.92 | — |
| B-1 | 36.8 | 2.88 | — |
| B-2 | 55.2 | 2.88 | — |
| B-3 | 73.6 | 2.88 | — |
| C-1 | 27.6 | 0.96 | — |
| C-2 | 55.2 | 0.96 | — |
| D | 92.0 | 4.80 | — |
| E | 46.0 | — | — |
| F | — | — | 0.4 |
| G | — | — | — |

The following describes, in order, production methods, evaluation methods, and evaluation results of the toners A-1 to G. In evaluations in which errors might occur, an evaluation value was calculated by calculating an arithmetic mean of an appropriate number of measured values in order to ensure that any errors were sufficiently small. A value for number average particle diameter was measured by capturing an image of particles using a transmission electron microscope (TEM), unless otherwise stated. A value for volume median diameter ($D_{50}$) was measured using "Coulter Counter Multisizer 3", product of Beckman Coulter, Inc., unless otherwise stated. A value for roundness was determined by measuring values of an appropriate number of particles (for example, 3000 particles) using a flow particle imaging analyzer ("FPIA (registered Japanese trademark) -3000", product of Sysmex Corporation) and calculating a number average of the values, unless otherwise stated. Acid values and hydroxyl values were measured in accordance with "Japanese Industrial Standard (JIS) K0070-1992", unless otherwise stated. SP values were calculated in accordance with the Fedors estimation method, unless otherwise stated. An SP value is represented by the formula "SP value=$(E/V)^{1/2}$" (E: molecular cohesive energy [cal/mol], V: molecular volume [$cm^3$/mol]). Tg (glass transition point) and Tm (softening point) were measured according to the methods described below, unless otherwise stated.

<Tg Measurement Method>

A heat absorption curve (vertical axis: heat flow (DSC signal), horizontal axis: temperature) for a sample (for example, a resin) was plotted using a differential scanning calorimeter ("DSC-6220", product of Seiko Instruments Inc.). Next, Tg (glass transition point) of the sample was read from the heat absorption curve. Tg (glass transition point) of the sample corresponds to a point of change in specific heat on the heat absorption curve (an intersection point of an extrapolation of the base line and an extrapolation of the inclined portion of the curve).

<Tm Measurement Method>

A sample (for example, a resin) was placed in a capillary rheometer ("CFT-500D", product of Shimadzu Corporation) and an S-shaped curve (horizontal axis: temperature, vertical axis: stroke) of the sample was plotted by causing melt-flow of 1 $cm^3$ of the sample under conditions of a die diameter of 1 mm, a plunger load of 20 kg/$cm^2$, and a heating rate of 6° C./minute. Next, Tm (softening point) of the sample was read from the S-shaped curve. Tm (softening point) of the sample is a temperature on the S-shaped curve corresponding to a stroke value of $(S_1+S_2)/2$, where $S_1$ represents a maximum stroke value and $S_2$ represents a base line stroke value at low temperatures.

[Production Method of Toner A-1]

(Preparation of Toner Cores)

A polyester resin (hydroxyl value=20 mgKOH/g, acid value=40 mgKOH/g, Tg=49° C., Tm=90° C., SP value=11.2) was synthesized by causing a reaction between bisphenol A ethylene oxide adduct (more specifically, an alcohol produced through addition of ethylene oxide to a bisphenol A framework) and an acid having multiple functional groups (more specifically, terephthalic acid). Next, 100 parts by mass of the thus obtained polyester resin, 5 parts by mass of a colorant ("KETBLUE 111", product of DIC Corporation, ingredient: Phthalocyanine Blue), and 5 parts by mass of an ester wax ("Nissan Electol (registered Japanese trademark) WEP-3", product of NOF Corporation) were mixed using an FM mixer (product of Nippon Coke & Engineering Co., Ltd.) at a rotational speed of 2,400 rpm.

Next, the resultant mixture was melt-kneaded using a twin-screw extruder ("PCM-30", product of Ikegai Corp.). Next, the resultant melt-kneaded product was cooled. Next, the cooled melt-kneaded product was pulverized using a mechanical pulverizer ("Turbo Mill", product of FREUND-TURBO CORPORATION). Next, the pulverized product was classified using a classifier ("Elbow Jet EJ-LABO", product of Nittetsu Mining Co., Ltd.). As a result, toner cores having a volume median diameter ($D_{50}$) of 6 μm, a roundness of 0.93, a Tg of 51° C., and a Tm of 91° C. were obtained.

(Preparation of Shell Material A)

A 1-L three-necked flask having a thermometer and a stirring impeller was set up in a water bath at a temperature of 30° C., and 815 mL of ion exchanged water and 75 mL of a cationic surfactant ("QUARTAMIN (registered Japanese trademark) 24P", product of Kao Corporation, ingredient: lauryltrimethylammonium chloride) were added into the flask. Next, the internal temperature of the flask was raised up to 80° C. and then maintained at the same temperature (80° C.) using the water bath. Next, two different liquids (a first liquid and a second liquid) were each dripped into the flask contents at 80° C. over 5 hours. The first liquid was a liquid mixture of 68 mL of styrene and 12 ml, of n-butyl acrylate. The second liquid was a solution of 0.5 g of potassium peroxodisulfate dissolved in 30 mL of ion exchanged water. Next, the internal temperature of the flask was maintained at 80° C. for further 2 hours to cause polymerization of the flask contents. As a result, a suspension of fine resin particles (hydrophobic resin) having a solid concentration of 8.0% by mass (hereinafter referred to as a hydrophobic suspension) was obtained. The fine resin particles included in the thus obtained hydrophobic suspension had a number average particle diameter of 31 nm and a Tg of 71° C.

(Preparation of Shell Material B)

A 1-L three-necked flask having a thermometer and a stirring impeller was set up in a water bath at a temperature of 30° C., and 790 mL of ion exchanged water and 30 mL of a cationic surfactant ("QUARTAMIN (registered Japanese trademark) 24P", product of Kao Corporation, a 25% by mass aqueous lauryltrimethylammonium chloride solution were added into the flask. Next, the internal temperature of the flask was raised up to 80° C. and then maintained at the same temperature (80° C.) using the water bath. Next, two different liquids (a third liquid and a fourth liquid) were each dripped into the flask contents at 80° C. over 5 hours.

The third liquid was a liquid mixture of 100 mL of methyl methacrylate, 30 mL of n-butyl acrylate, and 20 mL of dimethylaminopropyl acrylamide methyl chloride quaternary salt. The fourth liquid was a solution of 0.5 g of potassium peroxodisulfate dissolved in 30 mL of ion exchanged water. Next, the internal temperature of the flask was maintained at 80° C. for further 2 hours to cause polymerization of the flask contents. As a result, a suspension of fine positively chargeable resin particles charge control agent-containing resin) having a solid concentration of 15.0% by mass (hereinafter referred to as a positively chargeable suspension) was obtained. The fine resin particles included in the thus obtained positively chargeable suspension had a number average particle diameter of 55 nm and a Tg of 103° C.

(Shell Layer Formation Process)

A 1-L three-necked flask having a thermometer and a stirring impeller was set up in a water bath, and 300 mL of ion exchanged water was added into the flask. Next, the internal temperature of the flask was maintained at 30° C. using the water bath. Next, the flask content was adjusted to pH 4 through addition of a 1 mol/L aqueous p-toluenesulfonic acid solution to the flask. Next, 46 g of the shell material A (the hydrophobic suspension prepared as described above) and 1.92 g of the shell material B (the positively chargeable suspension prepared as described above) were added into the flask, and the flask contents were sufficiently stirred.

Next, 300 g of the toner cores (the toner cores produced as described above: see "Production Method of Toner A-1") were added into the flask, and the flask contents were sufficiently stirred. Next, 300 mL of ion exchanged water was added into the flask. Next, the internal temperature of the flask was raised at a rate of 1° C./minute while the flask contents were stirred at a rotational speed of 100 rpm. Once the internal temperature of the flask reached 50° C., a fifth liquid adjusted to a temperature of 50° C. was added into the flask. The fifth liquid was a liquid mixture of 20 g of a 0.5 mol/L aqueous disodium hydrogen phosphate solution and 10 g of a 10% by mass aqueous solution of an anionic surfactant ("Emal (registered Japanese trademark) 0", product of Kao Corporation, ingredient: sodium lauryl sulfate) (a solution of 1 g of the anionic surfactant (Emal 0) dissolved in 9 g of ion exchanged water). Next, the internal temperature of the flask was further raised at a rate of 1° C./minute while the flask contents were stirred at a rotational speed of 100 rpm. The heating was stopped once the roundness of the toner mother particles reached 0.965. Next, the flask contents were adjusted to pH 7 through addition of sodium hydroxide to the flask. Next, the temperature of the flask contents was cooled to room temperature (approximately 25° C.) to yield a dispersion containing the toner mother particles.

(Washing Process)

The dispersion of the toner mother particles obtained as described above was filtered (solid-liquid separation) using a Buchner funnel to obtain a wet cake of the toner mother particles. Next, the wet cake of the toner mother particles was re-dispersed in ion exchanged water. Dispersion and filtration were repeated five times for washing the toner mother particles.

(Drying Process)

Next, the washed toner another particles were dispersed in a 50% by mass aqueous ethanol solution. Through the above, a slurry of the toner mother particles was obtained. Next, a continuous type surface modifier ("Coatmizer (registered Japanese trademark)", product of Freund Corporation) was used to dry the toner mother particles in the slurry at a hot air temperature of 45° C. and a blower flow rate of 2 $m^3$/minute. As a result, a powder of the toner mother particles was obtained.

(External Additive Addition Process)

Next, the resultant toner another particles were subjected to external additive addition. More specifically, 100 parts by mass of the toner mother particles and 1.5 parts by mass of silica particles ("AEROSIL (registered Japanese trademark) REA90", product of Nippon Aerosil Co., Ltd., silica particles treated to be positively chargeable) were mixed for 5 minutes using an FM mixer (product of Nippon Coke & Engineering Co., Ltd.) to cause the external additive (silica particles) to adhere to the surfaces of the toner mother particles. Next, the resultant powder was sifted using a 200 mesh sieve (opening 75 μm). As a result, the toner A-1 including a plurality of toner particles was obtained.

[Production Methods of Toners A-2 to D]

The toners A-2, A-3, B-1 to B-3, C-1, C-2, and D were produced according to the same method as the production method of the toner A-1 in all aspects other than that the amount of the shell material A (hydrophobic suspension) and the amount of the shell material B (positively chargeable suspension) were changed as shown in Table 1 in the shell layer formation process.

[Production Method of Toner E]

The toner E was produced according to the same method as the production method of the toner A-1 in all aspects other than that the shell material B (positively chargeable suspension) was not used.

[Production Method of Toner F]

A 1-L three-necked flask having a thermometer and a stirring impeller was set up in a water bath, and 150 mL of ion exchanged water was added into the flask. Next, the internal temperature of the flask was maintained at 30° C. using the water bath. Next, the flask content was adjusted to pH 4 through addition of 1N hydrochloric acid to the flask. Next, 0.4 mL of a shell material C ("MIRBANE (registered Japanese trademark) RESIN SM-607", product of Showa Denko K.K., ingredient: an aqueous solution of hexamethylol melamine prepolymer, solid concentration: 80% by mass) was added into the flask, and the flask contents were sufficiently stirred.

Next, 150 g of the toner cores (the toner cores produced as described above) were added into the flask, and the flask contents were sufficiently stirred. Next, 150 mL of ion exchanged water was added into the flask. Next, the internal temperature of the flask was raised up to 70° C. at a rate of 1° C./minute while the flask contents were stirred at a rotational speed of 100 rpm.

Next, the flask contents were stirred for 2 hours under conditions of a temperature of 70° C. and a rotational speed of 100 rpm. Next, the temperature of the flask contents was cooled to room temperature (approximately 25° C.) at a rate of 5° C./minute. Next, the flask contents were adjusted to pH 7 through addition of 1N sodium hydroxide to the flask. As a result, a dispersion of toner mother particles was obtained.

Next, the washing process, the drying process, and the external additive addition process were performed according to the same procedures as in the production method of the toner A-1 to yield the toner F. Note that dispersion and filtration were repeated five times for washing the toner mother particles.

[Production Method of Toner G]

The toner G was produced according to the same method as the production method of the toner A-1 in all aspects other than that no shell layer was formed and the toner cores were used as the toner particles.

[Evaluation Methods]

Each sample (each of the toners A-1 to G) was evaluated according to the following methods.

(Shell Coverage)

The sample (toner) was dyed in ruthenium. A toner particle in the dyed sample was observed using a field effect scanning electron microscope (FE-SEM) ("JSM-7600F", product of JEOL Ltd.) and a backscattered electron image of the toner particle was captured. The speed of dyeing in ruthenium varies according to resins. For example, a polyester resin and a styrene-acrylic acid-based resin are greatly different in the speed of dyeing in ruthenium. Accordingly, there was contrast (luminance difference) between the toner core and the shell layer on the backscattered electron image captured (more specifically, the backscattered electron image of the surface of the toner particle), allowing the toner core and the shell layer to be distinguished from each other. Binarization was performed based on luminance values using image-analyzing software ("WinROOF", product of Mitani Corporation) to measure an area of a region, of the surface of the toner core, that was covered with the shell layer (hereinafter referred to as an area A1) and an area of the entire surface of the toner core (the region covered with the shell layer and a region not covered with the shell layer) (hereinafter, referred to as an area A2). Then, the shell coverage was calculated in accordance with a formula "shell coverage=100×area A1/area A2".

(Zeta Potential of Toner Mother Particles)

A dispersion of the toner mother particles of the sample (toner) was prepared by adding 1 g of the toner mother particles to 100 g of a 0.1% by mass aqueous solution of a nonionic surfactant ("EMULGEN (registered Japanese trademark) 120", product of Kao Corporation, ingredient: polyoxyethylene lauryl ether) and performing a 3-minute ultrasound treatment on the mixture. Next, the resultant dispersion of the toner mother particles was adjusted to a specific pH to give a pH adjusted dispersion of the toner mother particles. The pH adjusted dispersion of the toner mother particles was used as a measurement sample to measure the zeta potential of the toner mother particles by an electrophoresis method (more specifically, laser Doppler electrophoresis). More specifically, the zeta potential of the toner mother particles in the measurement sample at a temperature of 23° C. was measured using a zeta potentiometer ("ELSZ-1000", product of Otsuka Electronics Co., Ltd.).

First, the measurement sample was adjusted to pH 3.0 using dilute hydrochloric acid to measure the zeta potential of the toner mother particles in the measurement sample. Next, pH of the measurement sample was gradually increased using sodium hydroxide such that the pH ranged from 3.0 to 7.0, and the zeta potentials $\zeta(3)$ to $\zeta(7)$ of the toner mother particles at the respective pHs were measured. Based on the thus measured zeta potentials $\zeta(3)$ to $\zeta(7)$, an absolute value $|\zeta(3)-\zeta(4)|$ of a difference between the zeta potentials at lower pHs (the first amount of change) and an absolute value $|\zeta(6)-\zeta(7)|$ of a difference between the zeta potentials at higher pHs (the second amount of change) were determined. Each of the zeta potentials of the sample was measured three times, and an arithmetic mean of the thus obtained three measurement values was taken to be an evaluation value of the sample (toner) (zeta potential of the toner mother particles).

(High-Temperature Preservability)

A polyethylene container having a capacity of 20 mL was charged with 3 g of the sample (toner), and then sealed. Tapping was performed on the sealed container for 5 minutes. Next, the container was left to stand for 3 hours in a thermostatic chamber set to a specific temperature (55° C. or 58° C.). Next, the container in the thermostatic chamber was cooled to 20° C., and then the container was taken out of the thermostatic chamber. As a result, an evaluation toner was obtained.

Next, the evaluation toner was placed on a sieve having a pore diameter of 106 μm and a known mass. The mass of the evaluation toner prior to sifting was calculated by measuring the total mass of the sieve and the toner thereon. Next, the sieve was placed in a powder tester (product of Hosokawa Micron Corporation) and the sieve was shaken in accordance with a manual of the powder tester for 30 seconds at an oscillation strength corresponding to a rheostat level of 5. After the sifting, the mass of toner remaining on the sieve was calculated by measuring the total mass of the sieve and the toner thereon. Aggregation rate of the toner (unit: % by mass) was calculated from the mass of the toner prior to sifting and the mass of the toner after sifting (mass of the toner remaining on the sieve) based on a formula shown below.

$$\text{Aggregation rate}=100\times\text{mass of toner after sifting}/\text{mass of toner prior to sifting}$$

The aggregation rate was calculated for both the case where the temperature of the thermostatic chamber was set to 55° C. and the case where the temperature of the thermostatic chamber was set to 58° C. The evaluation standard based on the aggregation rate was as follows.

VG (Very Good): The aggregation rate was no greater than 20% by mass in both the experiment carried out at a temperature of 55° C. and the experiment carried out at a temperature of 58° C.

G (Good): The aggregation rate was greater than 20% by mass in the experiment carried out at a temperature of 58° C., and the aggregation rate was no greater than 20% by mass in the experiment performed at a temperature of 55° C.

P (Poor): The aggregation rate was greater than 20% by mass in both the experiment performed at 55° C. and the experiment performed at 58° C.

(Fixability and Fogging Density)

A ball mill was used to mix 100 parts by mass of a ferrite carrier (a carrier for "FS-C5100DN", product of KYOCERA Document Solutions Inc.) and 11 parts by mass of the sample (toner) for 30 minutes. As a result, a two-component developer was obtained.

An image was formed using the two-component developer prepared as described above to evaluate fixability, image density, and fogging density. As an evaluation apparatus, a color printer (an evaluation apparatus obtained by modifying "FS-C5100DN", product of KYOCERA Document Solutions Inc., to enable adjustment of fixing temperature) having a roller-roller type heat-pressure fixing device was used. The two-component developer prepared as described above was loaded into a developing device of the evaluation apparatus, and the sample (toner) was loaded into a toner container of the evaluation apparatus.

The following describes a method for evaluating fixability of the sample (toner). For evaluating fixability of the sample (toner), the evaluation apparatus was used to form a solid image with a size of 2.5 mm×25 mm on 90 g/m$^2$ paper (A4 size printing paper) at a toner application amount of 1.0 mg/cm$^2$ under environmental conditions of 23° C. and 60% RH. Next, the paper on which the image (more specifically, an unfixed toner image) was formed was passed through the fixing device with a nip having a width of 8 mm at a speed of 200 mm/second. The transit time of the paper through the nip was 40 milliseconds. The fixing temperature was set in a range of from 120° C. to 160° C. More specifically, the fixing temperature of the fixing device was gradually increased from 120° C. to measure the minimum temperature at which the toner (solid image) was fixable to the paper (minimum fixing temperature).

Determination of whether or not the toner was fixable was carried out through a fold-rubbing test such as described below. More specifically, the fold-rubbing test was performed by folding the paper in half such that a surface on which the image was formed was folded inwards, and by rubbing the fold with a 1 kg weight covered with cloth back and forth five times. Next, the paper was opened up and a fold portion (a portion on which the solid image was formed) of the paper was observed. Subsequently, the length of toner peeling of the fold portion (peeling length) was measured. The minimum fixing temperature was determined to be the lowest temperature among fixing temperatures for which the peeling length was no greater than 1 mm.

The evaluation standard based on the minimum fixing temperature was as follows. The evaluation standard was determined using the minimum fixing temperature (124° C.) of the toner cores (toner G) as a reference.

VG (Very Good): The minimum fixing temperature was no greater than 134° C.

G (Good): The minimum fixing temperature was greater than 134° C. and no greater than 149° C.

P (Poor): The minimum fixing temperature was greater than 149° C.

The following describes a method for evaluating fogging density of the sample (toner). For evaluating fogging density of the sample (toner), blank image printing was performed for 1 hour on successive sheets (approximately 1,500 sheets) of A4 size printing paper using the evaluation apparatus under environmental conditions of 23° C. and 60% RH. None of the toners A-1 to G used in the blank image printing resulted in fogging. Next, the developer taken out of the developing device of the evaluation apparatus and an unused developer (the two-component developer prepared as described above) were mixed for 1 minute using a ball mill. As a result, a developer in which the developer subjected to the printing durability test and the unused developer were mixed at a mass ratio of 1:1 (hereinafter referred to as a developer mixture) was obtained.

The thus obtained developer mixture was loaded into the developing device of the evaluation apparatus, and blank image printing was performed on 100 sheets of paper (A4 size printing paper) using the evaluation apparatus. Next, fogging density (FD) of each of the 100 sheets of paper after the blank image printing was measured. A largest value of the 100 measurement values was taken to be an evaluation value (fogging density) of the sample (toner). The fogging density (FD) was measured using a fully automatic brightness meter ("TC-6MC", product of Tokyo Denshoku CO., LTD.).

The evaluation standard based on the minimum fogging density (FD) was as follows.

VG (Very Good): The fogging density (FD) was no greater than 0.010.

G (Good): The togging density (FD) was greater than 0.010 and no greater than 0.015.

P (Poor): The fogging density (FD) was greater than 0.015.

[Evaluation Results]

With respect to each of the toners A-1 to G, results of the evaluations are shown in Tables 2 and 3,

TABLE 2

| Toner | Shell coverage | ζ(3) | ζ(4) | ζ(6) | ζ(7) | First amount of change ζ(3) − ζ(4) | Second amount of change ζ(6) − ζ(7) |
|---|---|---|---|---|---|---|---|
| A-1 | 60% | 24 | 5 | −13 | −27 | 19 | 14 |
| A-2 | 50% | 23 | 4 | −15 | −29 | 19 | 14 |
| A-3 | 30% | 22 | −3 | −15 | −28 | 25 | 13 |
| B-1 | 50% | 28 | 5 | −14 | −28 | 23 | 14 |
| B-2 | 70% | 30 | 7 | −12 | −28 | 23 | 16 |
| B-3 | 80% | 30 | 8 | −10 | −28 | 22 | 18 |
| C-1 | 40% | 18 | 2 | −18 | −32 | 16 | 14 |
| C-2 | 70% | 20 | 6 | −10 | −28 | 14 | 18 |
| D | 85% | 35 | 12 | −7 | −26 | 23 | 19 |
| E | 60% | 2 | −2 | −14 | −28 | 4 | 14 |
| F | 40% | 40 | 22 | −12 | −28 | 18 | 16 |
| G | 0% | −2 | −4 | −16 | −32 | 2 | 16 |

TABLE 3

| | Toner | Minimum fixing temperature [° C.] | High-temperature preservability 55° C. [mass %] | 58° C. [mass %] | Evaluation | Fogging |
|---|---|---|---|---|---|---|
| Example 1 | A-1 | 134 | 7 | 18 | VG | 0.006 |
| Example 2 | A-2 | 132 | 8 | 40 | G | 0.007 |
| Example 3 | B-1 | 132 | 7 | 40 | G | 0.006 |
| Example 4 | B-2 | 140 | 4 | 10 | VG | 0.007 |
| Example 5 | B-3 | 144 | 4 | 6 | VG | 0.005 |
| Example 6 | C-1 | 130 | 18 | 65 | G | 0.012 |
| Example 7 | F | 143 | 14 | 23 | G | 0.005 |
| Comparative Example 1 | A-3 | 128 | 60 | 95 | P | 0.020 (P) |
| Comparative Example 2 | C-2 | 140 | 5 | 12 | VG | 0.017 (P) |
| Comparative Example 3 | D | 154 (P) | 4 | 5 | VG | 0.005 |
| Comparative Example 4 | E | 134 | 6 | 16 | VG | 0.018 (P) |
| Comparative Example 5 | G | 124 | 90 | 100 | P | 0.020 (P) |

The toners A-1, A-2, B-1 to B-3, C-1, and F (the positively chargeable toners according to Examples 1 to 7) each had the aforementioned features (1) and (2). More specifically, the toner cores in each of the positively chargeable toners according to Examples 1 to 7 contained a polyester resin. Furthermore, as shown in Table 2, the shell layers in each of the positively chargeable toners according to Examples 1 to 7 covered at least 40% and no greater than 80% of the areas of the respective surfaces of the toner cores. Furthermore, as shown in Table 2, each of the positively chargeable toners according to Examples 1 to 7 had a ζ(4) of greater than 0 V and a ζ(6) of less than 0 V, and satisfied the relationship represented by $|\zeta(3)-\zeta(4)|>|\zeta(6)-\zeta(7)|$. In all the cases of the positively chargeable toners according to Examples 1 to 7, how the zeta potential varies with increasing pH (shape of the graph representing the relationship between pH and zeta potential) was substantially the same as the graph shown in FIGURE. The shell layers in each of the toners A-1, A-2, B-1 to B-3, and C-1 contained: a copolymer (first resin) of styrene and n-butyl acrylate; and a copolymer (second resin) of methyl methacrylate, n-butyl acrylate, and dimethylaminopropyl acrylamide methyl chloride quaternary salt. The shell layers in the toner F contained a melamine resin (thermosetting resin). As shown in Table 3, the positively chargeable toners according to Examples 1 to 7 were each excellent in both high-temperature preservability and fixability and were each capable of preferable image formation.

INDUSTRIAL APPLICABILITY

The positively chargeable toner according to the present invention can for example be used for image formation in a copier, a printer, or a multifunction peripheral.

The invention claimed is:

1. A positively chargeable toner comprising a plurality of toner particles each including a core and a shell layer disposed over a surface of the core, wherein the core contains a polyester resin, the shell layer covers at least 40% and no greater than 80% of an area of the surface of the core, $\zeta(4)$ is greater than 0 V, $\zeta(6)$ is less than 0 V, a relationship represented by $|\zeta(3)-\zeta(4)|>|\zeta(6)-\zeta(7)|$ is satisfied, and $\zeta(3)$, $\zeta(4)$, $\zeta(6)$, and $\zeta(7)$ represent zeta potentials of the positively chargeable toner with the toner particles having no external additive, $\zeta(3)$, $\zeta(4)$, $\zeta(6)$, and $\zeta(7)$ being respectively measured in an aqueous medium at pH 3, pH 4, pH 6, and pH 7.

2. The positively chargeable toner according to claim 1, wherein the shell layer contains a first resin and a second resin, the first resin is of stronger hydrophobic character than the second resin, and the second resin is of stronger positively chargeable character than the first resin.

3. The positively chargeable toner according to claim 2, wherein the first resin includes at least one repeating unit derived from a styrene-based monomer.

4. The positively chargeable toner according to claim 2, wherein the first resin is a copolymer of at least one styrene-based monomer and at least one acrylic acid-based monomer.

5. The positively chargeable toner according to claim 2, wherein the first resin includes one or more repeating units, and a repeating unit having the highest mole fraction of the repeating units is a repeating unit derived from a styrene-based monomer.

6. The positively chargeable toner according to claim 2, wherein the first resin includes one or more repeating units, and a proportion of a repeating unit having a functional group capable of forming a salt through ionization or a salt thereof is no greater than 10% by mass among all the repeating units.

7. The positively chargeable toner according to claim 2, wherein the second resin includes at least one repeating unit derived from a nitrogen-free vinyl compound and at least one repeating unit derived from a nitrogen-containing vinyl compound.

8. The positively chargeable toner according to claim 7, wherein the second resin includes at least one repeating unit derived from a quaternary ammonium compound as the repeating unit derived from the nitrogen-containing vinyl compound.

9. The positively chargeable toner according to claim 2, wherein the second resin is a copolymer of at least one quaternary ammonium compound and at least one (meth)acrylic acid ester.

10. The positively chargeable toner according to claim 2, wherein a glass transition point of the second resin is higher than a glass transition point of the first resin by at least 15° C.

11. The positively chargeable toner according to claim 2, wherein the first resin and the second resin include a repeating unit derived from a monomer common thereto.

* * * * *